US006764326B2

(12) United States Patent
Matsumoto et al.

(10) Patent No.: US 6,764,326 B2
(45) Date of Patent: Jul. 20, 2004

(54) ROTARY CONNECTOR HAVING SLIP RING MECHANISM

(75) Inventors: Tsuyoshi Matsumoto, Tokyo (JP); Hiroshi Oishi, Tokyo (JP)

(73) Assignee: Niles Parts Co., Ltd. (JP)

( * ) Notice: Subject to any disclaimer, the term of this patent is extended or adjusted under 35 U.S.C. 154(b) by 0 days.

(21) Appl. No.: 10/268,765

(22) Filed: Oct. 11, 2002

(65) Prior Publication Data

US 2003/0073333 A1 Apr. 17, 2003

(30) Foreign Application Priority Data

Oct. 11, 2001 (JP) ..... P2001-314612

(51) Int. Cl.[7] ..... H01R 3/00
(52) U.S. Cl. ..... 439/164; 439/15
(58) Field of Search ..... 439/164, 15, 16, 439/18, 19, 22, 25, 29

(56) References Cited

U.S. PATENT DOCUMENTS 3,479,632 A * 11/1969 Galles ..... 439/10
4,702,705 A * 10/1987 Hirano et al. ..... 439/15
5,470,236 A * 11/1995 Wissler ..... 439/12
5,588,843 A * 12/1996 Sobhani ..... 439/22
5,690,498 A * 11/1997 Sobhani ..... 439/22
6,039,588 A * 3/2000 Osawa ..... 439/164
6,095,836 A * 8/2000 Bolen et al. ..... 439/164
6,264,487 B1 * 7/2001 Taniuchi et al. ..... 439/164
6,371,779 B2 4/2002 Matsumoto
6,471,529 B2 * 10/2002 Oishi ..... 439/164

FOREIGN PATENT DOCUMENTS

JP 3-55955 8/1991
JP 2001-1961145 A 7/2001

* cited by examiner

*Primary Examiner*—Hae Moon Hyeon
(74) *Attorney, Agent, or Firm*—Rader, Fishman & Grauer PLLC

(57) ABSTRACT

A rotary connector includes a stationary housing, a rotative housing, a rotative holder, floating spacers, and flat cables. The flat cables provide a low-current path to a steering wheel of a vehicle. The rotary connector also includes a slip ring mechanism to provide a large-current path to electrical apparatuses on the steering wheel. The slip ring mechanism includes annular stationary contacts, annular movable contacts, and floating contacts. The annular stationary contacts are provided on the stationary housing and oppose the floating spacers to extend along a path of pivotal movement thereof. The annular movable contacts are provided on the rotative housing and oppose the floating spacers to extend along the path of pivotal movement thereof. The movable contacts are connected to electrical apparatuses on the steering wheel side. The floating contacts are provided on the floating spacers and are in resilient contact with the stationary contacts and the movable contacts.

10 Claims, 9 Drawing Sheets

ROTARY CONNECTOR HAVING SLIP RING MECHANISM

BACKGROUND OF THE INVENTION

1. Field of the Invention

The present invention relates generally to electrical connectors for automotive vehicles. In particular, the present invention relates to a rotary connector that connects a steering wheel of a vehicle and a vehicle body electrically.

2. Description of the Related Art

One such prior art rotary connector is described in, for example, Japanese Patent Publication No. 355955. This rotary connector has a housing body that includes a rotor housing and a stator housing. The housing body houses a spiraled flat cable that makes electrical connection between a vehicle body and a steering wheel. The housing body houses a spiraled flat cable that makes electrical connection between a vehicle body and a steering wheel. Such a connector is used for an air bag system or an alarm system that is provided to a steering wheel. Because the flat cable carries small currents, the flat cable is of the construction in which thin wires are covered with a film material. The flat cable of the prior art rotary connector functions sufficiently for carrying small currents.

Recently, some steering wheels have a heater, which requires a large current. If the aforementioned flat cable is used for supplying a current to a handle heater, there is a possibility that the wires of the flat cable generate too much heat and melt the film material covering the wires. Therefore, the wires of the flat cable are not capable of carrying a large current, and the flat cable is unsuitable for a handle heater.

In view of this problem, the applicant of the present invention has proposed a structure disclosed in Japanese Patent Laid-Open No. 2001-196145. This structure includes a flat cable and an additional cord for carrying a large current for a handle heater. This structure uses a flat cable for supplying small currents to, for example, an air bag and an alarm, and a large-current cord for supplying a large current to the handle heater.

However, the aforementioned large-current cord runs through a shaft sleeve inserted into a steering shaft and is connected to a power supply through a slip ring mechanism outside of the stationary stator housing. To accommodate the large-current cord and slip ring mechanism, a special space is required in the shaft sleeve and outside of the stator housing. Thus, the overall height of the apparatus increases by the height of the slip ring mechanism, making the apparatus large in size.

In addition, because the cord runs in the shaft sleeve, there is a possibility that the cord contacts a steering shaft to rub the steering wheel. Also, since the slip ring mechanism is provided outside of the stator housing, the sounds created by the slip ring mechanism may leak to the outside and cause abnormal sounds.

In rotary connectors used for automobiles, a large number of switches are arranged in the pads and spoke of the steering wheel, and a large number of wires are required for making electrical connection between the switches and the vehicle body. However, because various devices are mounted around the steering wheel, the axial height of the flat cable having wires therein and the height of a rotary connector have to be designed to a specific value. This limits the number of wires that can be included in the flat cable, e.g., several wires.

Some rotary connectors have a plurality of flat cables in order to solve this problem. However, the number of flat cables is limited only to two or three due to a limited space for mounting terminals to which the opposed ends of the flat cables are fixed.

SUMMARY OF THE INVENTION

A first object of the present invention is to provide a rotary connector that allows increasing the number of electrical paths that connect the vehicle body and the steering wheel while still maintaining the overall size as small as possible.

A second object of the invention is to provide a rotary connector that has a large-current path in addition to the flat cable while still maintaining the overall size of the rotary connector as small as possible.

A third object is to provide a rotary connector that prevents occurrence of abnormal sounds.

To accomplish these and other objects of the invention, a rotary connector is provided having a stationary member supported on a body side of an automobile; a rotative member rotatably supported on the stationary member, the rotative member being rotatable together with a steering wheel; a floating spacer disposed between the stationary member and the rotative member and having a gap that extends in a radial direction of the floating spacer so that an inner space of the floating spacer communicates with an outer space of the floating spacer through the gap, the floating spacer being pivotal when the rotative member rotates; and a flat cable having one end that is supported on the stationary member and connected to a power supply side, the other end that is supported on the rotative member and connected to an electrical apparatus on the steering wheel side, and a mid folding portion that passes through the gap in a floating spacer to fold back so that the flat cable is wound around the outer surface and the inner surface of the floating spacer, the flat cable lying between the stationary member and the rotative member.

The rotary connector has a slip ring mechanism, comprising: a stationary contact provided on the stationary member, the stationary contact being connected to the power supply and opposing the floating spacer so that the stationary contact extends along a pivotal path of the floating spacer; a movable contact provided on the rotative member, the movable contact being connected to an electrical apparatus on the steering wheel side and opposing the floating spacer so that the movable contact extends along a pivotal path of the floating spacer; and a floating contact provided to the floating spacer which is electrically connected to the stationary contact and the movable contact.

According to another aspect of the present invention, the rotary connector further comprises an annular stationary contact provided on the stationary member, the annular stationary contact being connected to the power supply and opposing the floating spacer to extend along the pivotal path of the floating spacer; an annular movable contact provided on the rotative member, the annular movable contact being connected to the electrical apparatus on the steering wheel side and opposing the floating spacer to extend along the pivotal path of the floating spacer; and a floating contact provided to the floating spacer which is in resilient contact with the stationary contact and the movable contact.

According to another aspect of the present invention, the rotary connector further comprises a contact-receiving recess formed in the floating spacer and receiving the floating contact therein and exposing two opposed ends of the floating contact to the stationary contact and the movable contact. The floating contact is received in the contact receiving recess.

According to yet another aspect of the present invention, the floating contact has contacts on its opposed two ends thereof and an electrically conductive spring that makes the contacts electrically continuous with each other and makes the floating contact in resilient contact with the stationary contact and the movable contact.

Numerous other objects of the present invention will be apparent to those skilled in this art from the following description wherein there is shown and described an embodiment of the present invention, simply by way of illustration of one of the modes best suited to carry out the invention. As will be realized, the invention is capable of other different embodiments, and its several details are capable of modification in various obvious aspects without departing from the invention. Accordingly, the drawings and description should be regarded as illustrative in nature and not restrictive.

BRIEF DESCRIPTION OF THE DRAWINGS

The present invention will become more clearly appreciated as the disclosure of the invention is made with reference to the accompanying drawings. In the drawings.

DETAILED DESCRIPTION OF THE INVENTION

Figure 1:
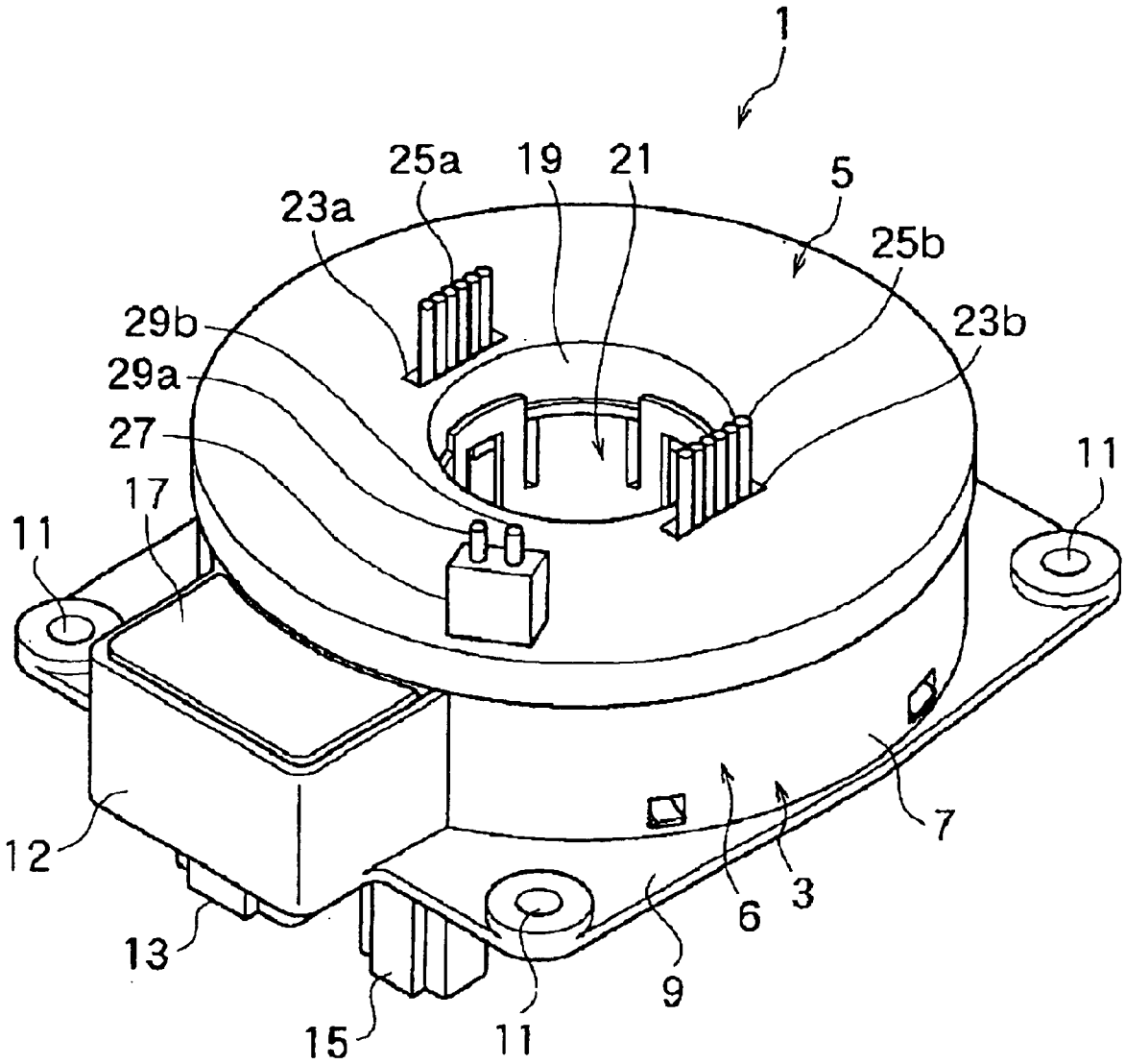
FIG. 1 is a perspective view of a rotary connector according to a first embodiment of the invention.
Figure 2:
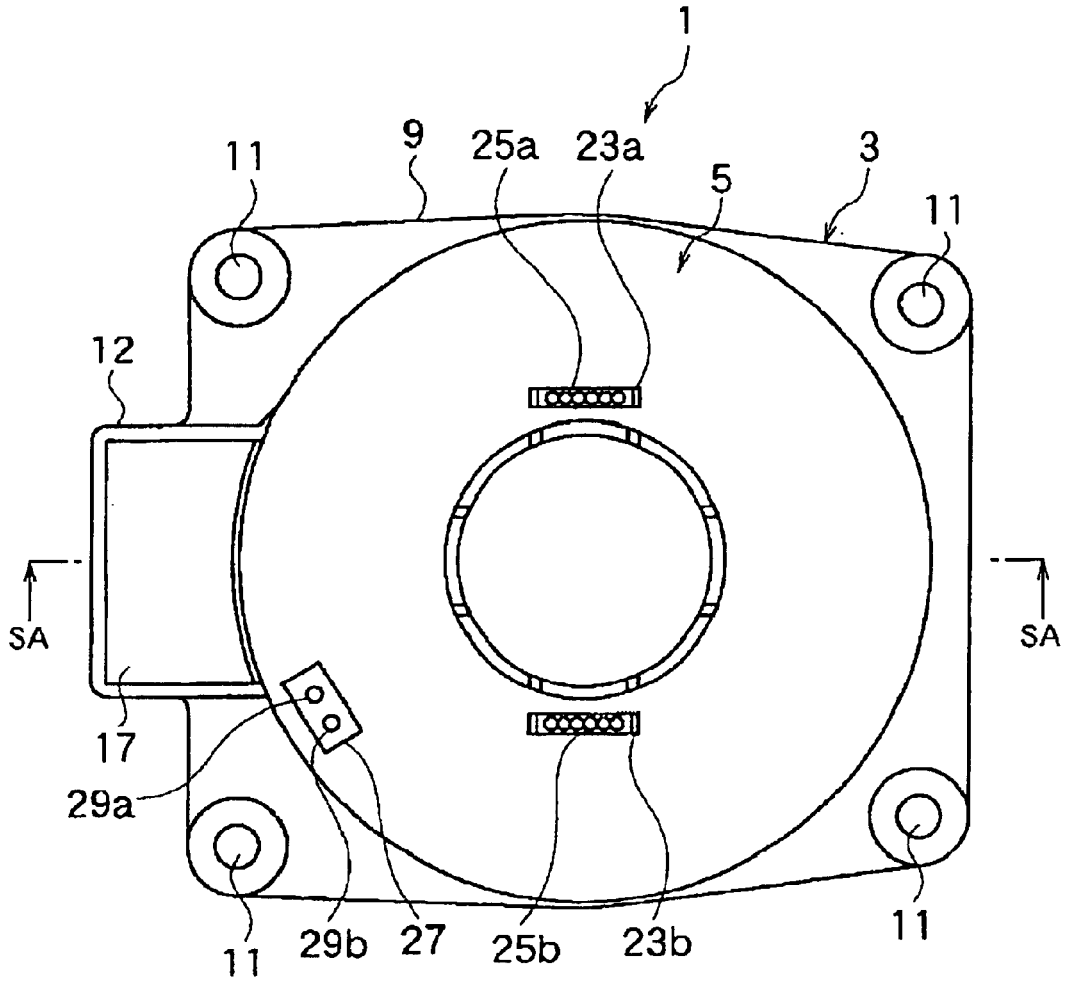
FIG. 2 is a top view of the rotary connector according to the first embodiment.

FIG. 1 is a perspective view and FIG. 2 is a top view of a rotary connector 1 according to a first embodiment of the present invention. The rotary connector 1 in FIGS. 1 and 2 is used to make electrical connection between various apparatuses provided on a steering wheel side of an automobile and a power supply on the vehicle side.

The rotary connector 1 includes a stationary housing 3 that serves as a stationary member, and a rotative housing 5 that serves as a rotative member. The stationary housing 3 is formed of, for example, a resin material and is fixedly mounted to the body of an automobile. According to the present embodiment, the base of a combination switch is fixed to a steering column on the body of an automobile. The stationary housing 3 includes a side housing 6 having a cylindrical wall 7 formed in one piece with flanges 9. Each flange 9 has a mounting hole 11 formed therethrough so that the side housing 6 can be fastened via the mounting hole 11. Thus, the stationary housing 3 is positioned relative to the combination switch with the mounting flanges 9 aligned with the base of the combination switch. Bolts are inserted into the mounting holes 11 and then screwed into nuts, thereby fastening the stationary housing 3.

The stationary housing 3 has a frame 12 on one side of the wall 7 and a small-current connector 13 is provided under the frame 12. The frame 12 has an upper opening capped with a lid 17 which is detachably fitted to the upper opening of the frame 12. The housing 3 also has a large-current connector 15 provided near the small-current connector 13.

The rotative housing 5 is rotatably supported on the stationary housing 3 and is rotatable together with the steering wheel. The rotative housing 5 is formed of a resin material substantially into a doughnut-shape. The rotative housing 5 has a cylindrical outer geometry configured to the cylindrical side wall 7 of the stationary housing 3, the cylindrical outer geometry being substantially the same size as the cylindrical side wall 7. The rotative housing 5 has a shaft sleeve 19 formed in the middle thereof. The rotative housing 5 has a rotative holder 77 assembled integrally with the rotative housing 5. Alternatively, the rotative housing 5 and the rotative holder 77 may be made in one piece construction.

The stationary housing 3 and the rotative housing 5 are coupled through an attachment 21 in such a way that the housings 3 and 5 are rotatable relative to each other. The rotative housing 5 is formed with a pair of rectangular through-holes 23*a* and 23*b* through which later-described terminals 25*a* and 25*b* of the flat cables extend.

A large-current connector 27 is provided on the upper surface of a rotative housing 5, and large-current terminals 29*a* and 29*b* project upward from the connector 27. The large-current terminals 29*a* and 29*b* are connected to a connector of an electrical apparatus provided on the steering wheel side. One such electrical apparatus is a handle heater that heats the steering wheel to provide a warm grip for the operator.

Figure 3:
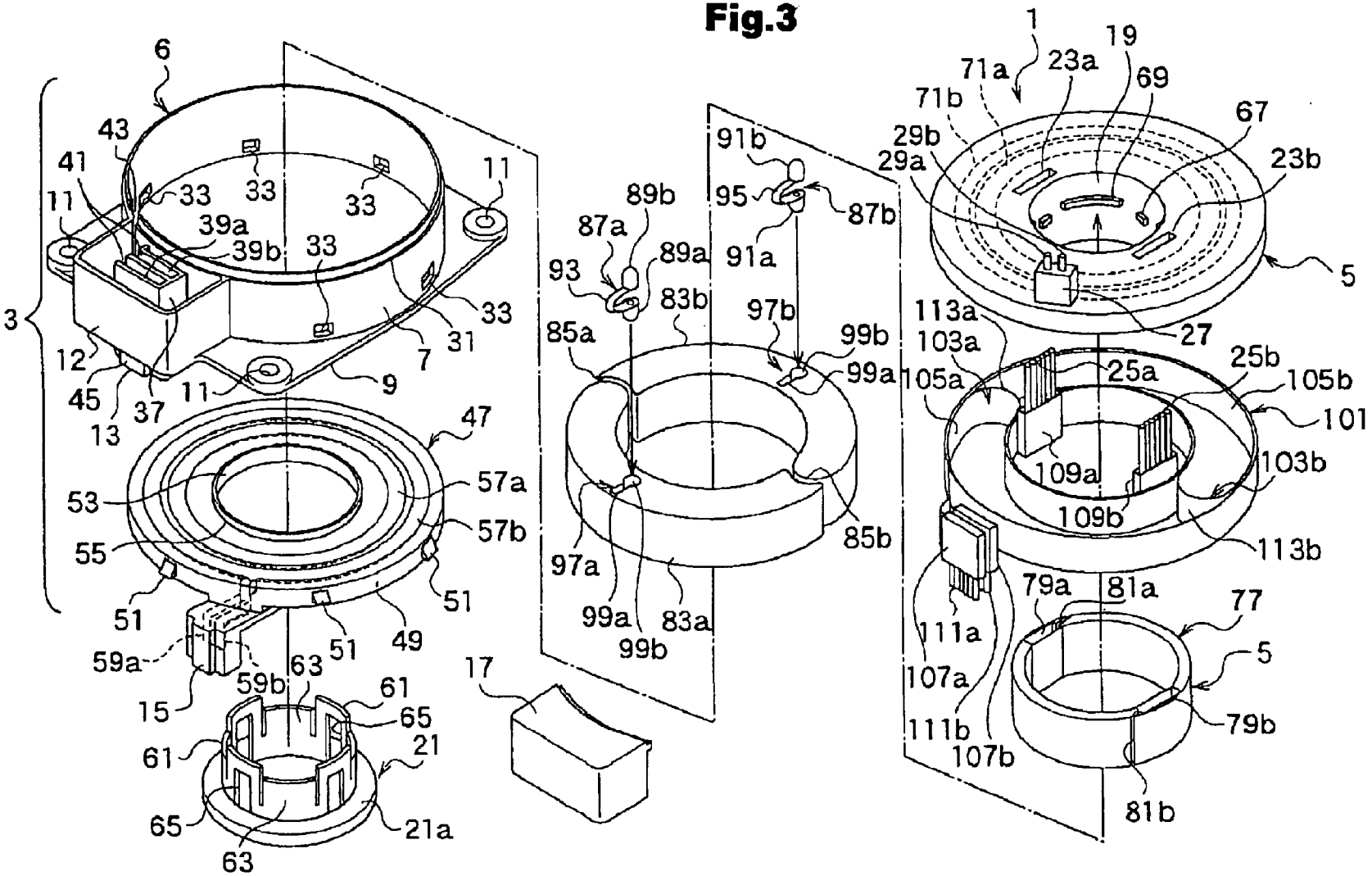
FIG. 3 is an exploded perspective view of the rotary connector according to the first embodiment.
Figure 4:
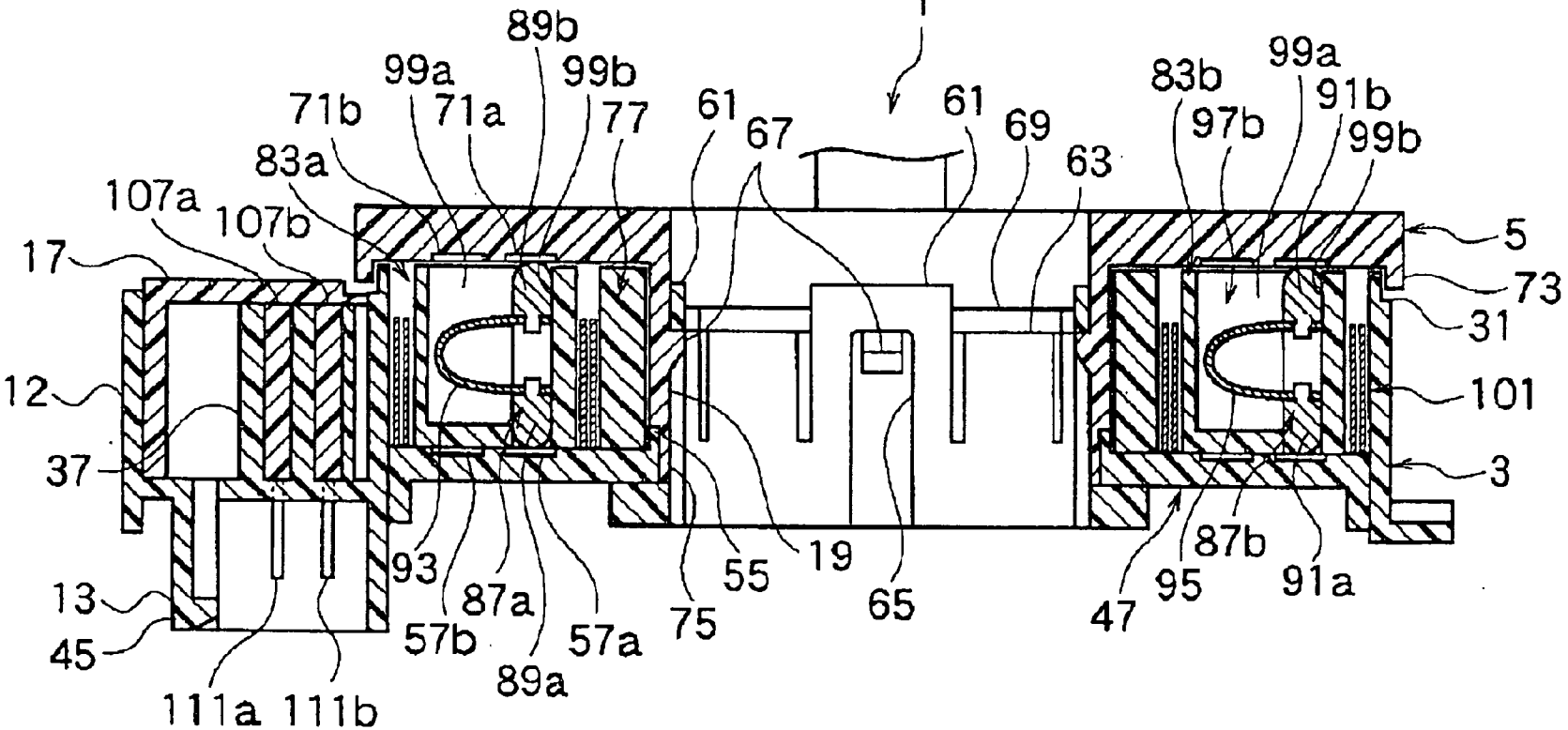
FIG. 4 is a cross-sectional view of the first embodiment taken along line SA—SA of FIG. 2.

The rotary connector 1 will be further described with reference to FIGS. 3 and 4. FIG. 3 is an exploded perspective view of the rotary connector 1. FIG. 4 is a cross-sectional view taken along line SA—SA of FIG. 2.

As shown in FIGS. 3 and 4, the cylindrical wall 7 of the side housing 6 of the stationary housing 3 has an upper edge portion 31 formed in the shape of a step. The side wall 7 is formed with engagement holes 33 aligned in a circumferential direction at equal intervals.

The small-current connector 13 has a terminal support 37 in the frame 12 and a hood 45 below the frame 12. The terminal support 37 has a pair of recesses 39*a* and 39*b* for accommodating the terminals. There are provided slits 41 beside the recesses 39*a* and 39*b*, respectively. The side wall 7 is formed with a slit 43 through which the space inside of the side wall 7 communicates with the space inside of the frame 12.

The stationary housing 3 has a bottom housing 47 that is coupled to the side housing 6. The stationary housing 3 may be of the construction in which the side housing 6 and the bottom housing 47 are formed in one piece. The bottom housing 47 is molded from a resin material into the shape of a doughnut. The outer diameter of the bottom housing 47 is much the same as the inner diameter of the side wall 7 of the side housing 6, so that the bottom housing 47 can be fitted into the side wall 7 of the side housing 6. A center hole 53 formed in the bottom housing 47 has a bearing portion 55 that projects axially and serves as a bearing for the rotative housing 5.

The bottom housing 47 has a plurality of engagement lugs 51 that project from an outer circumferential surface 49 of the bottom housing 47. These engagement lugs 51 are formed corresponding to engagement holes 33 formed in the side wall 7 of the side housing 6, so that when the engagement lugs 51 engage the engagement holes 33, the bottom housing 47 is assembled to the side housing 6.

There are provided a pair of annular stationary contacts 57*a* and 57*b* on the upper surface of the bottom housing 47. The stationary contacts 57*a* and 57*b* are insert molded with the bottom housing 47 molded from a resin material, and the upper surface of the stationary contacts 57*a* and 57*b* are substantially flush with the upper surface of the bottom housing 47. The upper surface of the bottom housing 47 in which the annular stationary contacts 57*a* and 57*b* are formed opposes floating spacers which will be described later.

Along the locus of pivotal movement of the floating spacers, the stationary contacts 57*a* and 57*b* are formed in an annular shape. The stationary contacts 57*a* and 57*b* are connected to the power supply side, and terminals 59*a* and 59*b* extend from portions of the stationary contacts 57*a* and 57*b*, respectively. The terminals 59*a* and 59*b* are exposed in the large-current connector 15 that is formed in one piece with the bottom housing 47.

Thus, in the present embodiment, the stationary contacts 57*a* and 57*b* are provided on the stationary housing 3 side. The stationary contacts 57*a* and 57*b* are connected to the power supply and oppose the floating spacers to form an annular shape along the pivotal path of movement of the floating spacers.

The attachment 21 is formed of a resin material and couples the stationary housing 3 to the rotative housing 5 as described. The attachment 21 has four resilient tongues 61 and four abutting straps 63 between the tongues 61. The tongues 61 and abutting straps 63 are alternate each other in a circumferential direction. Each resilient tongue 61 has a fitting window 65 formed therein.

The rotative housing 5 has coupling lugs 67 and abutting straps 69 formed on the inner circumferential surface of the shaft sleeve 19. The coupling lugs 67 are formed at four locations in a circumferential direction, corresponding to the fitting windows 65. The abutting straps 69 are formed at four locations in a circumferential direction, corresponding to the abutting strap 63.

There are provided a pair of annular movable contacts 71*a* and 71*b* on the underside of the rotative housing 5. The movable contacts 71*a* and 71*b* are insert-molded with the rotative housing 5 formed of a resin material. The surfaces of the movable contacts 71*a* and 71*b* are flush with the underside of the rotative housing 5. The inner movable contact 71*a* has the same diameter and width as the stationary contact 57*a*, and the outer movable contact 71*b* has the same diameter and width as the stationary contact 57*b*. The underside of the rotative housing 5 on which the annular movable contacts 71*a* and 71*b* are formed opposing the floating spacers will be described later.

Formed along the locus of the pivotal motion of the floating spacers are the movable contacts 71*a* and 71*b*. The movable contacts 71*a* and 71*b* are connected to electrical apparatuses on the steering wheel side. Portions of the movable contacts 71*a* and 71*b* extend just as the terminals 59*a* and 59*b* of the stationary contacts 57*a* and 57*b*, so that the portions of the movable contacts 71*a* and 71*b* are electrically connected to the terminals 29*a* and 29*b* of the large-current connector 27. As mentioned above, one such electrical apparatus is a handle heater that heats the steering wheel.

Thus, in the present embodiment, the annular movable contacts 71*a* and 71*b* are provided on the rotative housing 5 side. The annular movable contacts 71*a* and 71*b* are connected to the electrical apparatuses on the steering wheel side as well as opposing the floating spacers to describe a ring shape along the locus of pivotal movement of the floating spacers. The slip ring mechanism is formed of the stationary contacts 57*a* and 57*b* and the movable contacts 71*a* and 71*b*. The flat springs 93 and 95 may also be applied to electrical apparatuses that consume small currents.

As shown in FIG. 4, the rotative housing 5 has a circumferential flange 73 on its outermost edge. The circumferential flange 73 fits over the upper end portion 31 of the stationary housing 3. The rotative housing 5 also has a shaft engagement step 75 formed in a lower end portion of a circumferential surface of the shaft sleeve 19. The shaft engagement step 75 fits to the bearing portion 55 of the bottom housing 47.

The rotative holder 77 is disposed between the stationary housing 3 and the rotative housing 5. The rotative holder 77 is formed of, for example, a resin material in the shape of a ring, and can rotate together with the steering wheel. The inner diameter of the rotative holder 77 is slightly larger than the outer diameter of the shaft sleeve 19 of the rotative housing 5. The rotative holder 77 fits over the shaft sleeve 19 in such a way that the rotative holder 77 is rotatable relative to the shaft sleeve 19. The rotative holder 77 has terminal fitting portions 79*a* and 79*b*. The terminal fitting portions 79*a* and 79*b* have slits 81*a* and 81*b* formed therein, respectively.

The rotative holder 77 may be formed in one piece with the rotative housing 5 in such a way that the rotative holder 77 depends from an inner ceiling of the rotative housing 5. The rotative holder 77 may be formed in one piece with the shaft sleeve 19 of the rotative housing 5. If the rotative holder 77 and rotative housing 5 are formed in one piece, terminals 109*a* and 109*b* of the first and second flat cables 103*a* and 103*b* fit into the through-holes 23*a* and 23*b* from the underside. The terminal fitting portions 79*a* and 79*b* of the rotative holder 77 may also serve as the through-holes 23*a* and 23*b* of the rotative housing 5 or may be communicated with the through-holes 23*a* and 23*b*. The ring-shaped rotative holder 77 is required only to fix the terminals 109*a* and 109*b* to the rotative housing 5, i.e., the rotative holder 77 may have a shape such as a box or a connector, or may have any other shapes.

There are provided floating spacers 83*a* and 83*b* between the stationary housing 3 and rotative housing 5. The floating spacers 83*a* and 83*b* surround the rotative holder 77. The floating spacers 83*a* and 83*b* are molded from, for example, a resin material. The floating spacers 83*a* and 83*b* are disposed in a mating manner to make a ring shape. The floating spacers 83*a* and 83*b* each have a convex end and a concave end so that the convex ends of the floating spacers 83*a* and 83*b* face the concave ends of the floating spacers 83*a* and 83*b* to define gaps 85*a* and 85*b*. Thus, the stationary housing 3 on the outside of the floating spacers 83*a* and 83*b* can communicate with the rotative holder 77 on the inside of the floating spacers 83*a* and 83*b* through the gaps 85*a* and 85*b*. The gaps 85*a* and 85*b* are in the shape of a curved slit.

A plate-like member is provided to the bottoms of the floating spacers 83*a* and 83*b* so that upper ends of the gaps 85*a* and 85*b* are open. The floating spacer 83*a* and floating spacer 83*b* are joined integrally at the bottom portions of the gaps 85*a* and 85*b*. Alternatively, the floating spacers 83*a* and 83*b* may be separated from each other at the gaps 85*a* and 85*b*. Still alternatively, a plurality of projections may be formed on upper inner surfaces of the floating spacers 83*a* and 83*b*, and a stepped portion may be formed in an upper outer circumferential surface of the rotative holder 77. Then, the floating spacers 83*a* and 83*b* may be assembled to the rotative holder 77 in such a way that the plurality of projections engage the stepped portion to allow the floating spacers 83*a* and 83*b* to hang from and slide on the stepped portion.

The floating spacers 83*a* and 83*b* have a pair of floating contacts 87*a* and 87*b*. The floating contact 87*a* resiliently contacts the stationary contact 57*a* and movable contact 71*a*, while the floating contact 87*b* resiliently contacts the stationary contact 57*b* and movable contact 71*b*.

The movable contacts 87*a* have bullet-shaped contacts 89*a* and 89*b*. The movable contacts 87*b* have bullet-shaped contacts 91*a* and 91*b*. The contacts 89*a* and 89*b* are coupled together through an electrically conductive flat spring 93, while the contacts 91*a* and 91*b* are coupled together through an electrically conductive flat spring 95. Thus, the contacts 89*a* and 89*b* are electrically continuous to each other through the flat spring 93, and the contacts 91*a* and 91*b* are electrically continuous to each other through the flat spring 95.

The resilient force of the flat spring 93 causes the contacts 89*a* and 89*b* to resiliently contact with the stationary contact 57*a* and movable contact 71*a*, respectively. The resilient force of the flat spring 95 causes the contacts 91*a* and 91*b* to resiliently contact with the stationary contact 57*b* and movable contact 71*b*, respectively. Instead of forming the contacts 89*a*, 89*b*, 91*a*, and 91*b*, the flat springs 93 and 95 may be bent at their end portions so that the flat spring 93 directly contacts the stationary contacts 57*a* and movable contact 71*a*, and the flat spring 95 directly contacts the stationary contact 57*b* and movable contact 71*b*.

The movable contacts 87*a* and 87*b* are supported by the contact receiving recesses 97*a* and 97*b* provided on the floating spacers 83*a* and 83*b*, respectively. The contact receiving recesses 97*a* and 97*b* include spring receiving portions 99*a* and contact receiving portions 99*b*, respectively, which are configured to the shapes of the movable contacts 87*a* and 87*b*, respectively. These contact receiving recesses 97*a* and 97*b* are not arranged in the same orientation, i.e., the recess 97*a* has the contact receiving portion 99*b* close to the inner circumferential surface of the floating spacer 83*a*, and the recess 97*b* has the contact receiving portion 99*b* close to the outer circumferential surface of the floating spacer 83*b*.

With the movable contacts 87*a* and 87*b* accommodated in the contact receiving recesses 97*a* and 97*b*, the contacts 89*a* and 89*b* on the opposite ends of the floating contact 87*a* project from the contact receiving portion 99*a* to resiliently contact the stationary contact 57*a* and movable contact 71*a*, and the contacts 91*a* and 91*b* on the opposite ends of the floating contact 87*b* project from the contact receiving portion 99*b* to resiliently contact the stationary contact 57*b* and movable contact 71*b*. In this manner, the contacts 57*a* and 57*b*, movable contacts 71*a* and 71*b*, and floating contacts 87*a* and 87*b* form a so-called slip ring mechanism in a space defined between the stationary housing 3 and rotative housing 5.

A set 101 of wound flat cables is provided in a space defined between the stationary housing 3 and the rotative holder 77. The set 101 of flat cables according to the embodiment includes two cables: a first flat cable 103*a* and a second flat cable 103*b*. The first flat cable 103*a* and second flat cable 103*b* include fixed-end terminals 107*a* and 107*b* at one end of flat portions 105*a* and 105*b*, and rotating-end terminals 109*a* and 109*b* at their other end of flat portions 105*a* and 105*b*, respectively. The fixed-end terminals 107*a* and 107*b* are connected to the power supply and have terminals 111*a* and 111*b*, respectively.

The rotating-end terminals 109*a* and 109*b* are connected to the electrical apparatuses on the steering wheel side, and have terminals 25*a* and 25*b*, respectively. The electrical apparatuses in the embodiment include, for example, an air bag apparatus or an alarm provided to the steering wheel, a shift down switch and a shift-up switch for an automatic transmission, an ASCD (auto speed control device) switch, and an audio switch.

The flat portions 105*a* and 105*b* include a plurality of belt-shaped electrically conductive wires sandwiched between two sheets of resin films made of an insulating resin, the conductive wires being spaced apart by a predetermined distance. The resin films are heated under pressure, thereby forming a flat cable integrally.

The terminals 111*a*, 111*b*, 25*a*, and 25*b* are insert-molded from a resin material with the terminal 107*a*, 107*b*, 109*a*, and 109*b*. The terminals 111*a*, 111*b*, 25*a*, and 25*b* are connected to the conductive wires on the flat portions 105*a* and 105*b*.

The first flat cable 103*a* is wound as follows: Starting from the fixed-end terminal 107*a*, the first flat cable 103*a* makes a round through the outermost circumference, then passes by an inner side of the other fixed-end terminal 107*b* to reach a mid folding portion 113*a*. Then, the first flat cable 103*a* folds back to be wound counterclockwise at the mid folding portion 113*a*, and then makes about a round and half run through the inner circumference, reaching the other rotating-end terminal 109*b*.

Starting from the fixed-end terminal 107*b*, the second flat cable 103*b* makes about ¾ of one complete run clockwise through the outermost circumference, reaching a mid folding portion 113*b* where the second flat cable 103*b* folds back. Then, the second flat cable 103*b* makes about a round and a half counterclockwise, finally reaching the rotating-end terminal 109*a*.

The fixed-end terminals 107*a* and 107*b* on the first and second flat cables 103*a* and 103*b* are accommodated in terminal receiving recesses 39*a* and 39*b* of the stationary housing 3, and the terminals 111*a* and 111*b* project into the hood 45 of the small-current connector 13.

With the fixed-end terminals 107*a* and 107*b* accommodated in the terminal receiving recesses 39*a* and 39*b*, respectively, the flat portions 105*a* and 105*b* of the flat cables 103*a* and 103*b* are inserted into the slits 41 and 43, respectively, through a space between the side housing 6 and the floating spacers 83*a* and 83*b*. The flat portions 105*a* and 105*b* then pass along the inner circumferential surface of the side wall 7 of the stationary housing 3, and then through the frame 12 to reach the terminal receiving recesses 39*a* and 39*b*.

The other rotating-end terminals 109*a* and 109*b* of the flat cables 103*a* and 103*b* fit to the terminal fitting portions 79*a* and 79*b* of the rotative holder 77, respectively, and the terminals 25*a* and 25*b* project from the rotative housing 5 through the through-holes 23*a* and 23*b*, respectively. The flat portions 105*a* and 105*b* of the first and second flat cables 103*a* and 103*b* pass through a space between the rotative housing 5 and the floating spacers 83*a* and 83*b* to reach the terminal fitting portions 79*a* and 79*b* through the slits 81*a* and 81*b*.

In this manner, one cable of the set 101 of flat cables is folded at the mid folding portion 113*a* and inserted into the gap 85*a* defined between the floating spacers 83*a* and 83*b*, and the other cable of the set 101 of flat cables is folded at the mid folding portion 113*b* and inserted into the other gap 85*b*, so that the set 101 of flat cables is wound along the inner circumferential surfaces and the outer circumferential surfaces of the floating spacers 83*a* and 83*b* in a space defined between the stationary housing 3 and the rotative housing 5.

With the above-described structure, the side housing 6 and the bottom housing 47 of the stationary housing 3 are coupled when the engagement hole 33 engages the lugs 51. In the stationary housing 3, the rotative holder 77, floating spacers 83*a* and 83*b*, and set 101 of flat cables are combined as described above. The fixed-end terminals 107*a* and 107*b* of the set 101 of flat cables are accommodated in the terminal receiving recesses 39*a* and 39*b*, respectively, and the rotating-end terminals 109*a* and 109*b* are accommodated in the terminal fitting portions 79*a* and 79*b* of the rotative holder 77.

The contact receiving recesses 97*a* and 97*b* receive the floating contacts 87*a* and 87*b*, and the rotative housing 5 fits over the contact receiving recesses 97*a* and 97*b* and the floating contacts 87*a* and 87*b*. With this condition, the terminals 25*a* and 25*b* on the inner circumferential surface of the set 101 of the flat cables project outwardly from the through-holes 23*a* and 23*b* formed in the rotative housing 5, respectively.

The attachment 21 is inserted into the bottom housing 47 through the inner hole 53, so that the resilient tongues 61 deform to cause the coupling lugs 67 to engage the fitting windows 65 formed in the resilient tongues 61. With this condition, the abutting straps 63 of the attachment 21 abut the abutting straps 69 of the rotative housing 5, thereby positioning the attachment 21 relative to the rotative housing 5.

Grease is applied on the flange surface 21*a* of the attachment 21 so as to reduce sliding resistance between the attachment 21 and the bottom housing 47. The flange surface 21*a* of the attachment 21 may be formed with a circumferential groove therein for holding grease.

With this assembling condition, the floating contacts 87*a* and 87*b* are pushed into the contact receiving recesses 97*a* and 97*b*, respectively, so that the flat springs 93 and 95 are caused to flex to exhibit resilient forces. As a result, the contact 89*a* of the floating contact 87*a* resiliently contacts the stationary contact 57*a* on the stationary housing 3, while the contact 89*b* of the floating contact 87*a* resiliently contacts the movable contact 71*a* on the rotative housing 5. Likewise, the contact 91*a* resiliently contacts the stationary contact 57*b* on the stationary housing 3, while the contact 91*b* resiliently contacts the movable contact 71*b* on the rotative housing 5.

With the rotary connector 1 assembled as described above, the stationary housing 3 is fastened to the base of the combination switch as mentioned previously, and the large-current connector 27 on the rotative housing 5 side fits to the steering wheel side, so that the terminals 29*a* and 29*b* of the connector 27 are connected to the electrical apparatuses on the steering wheel side. When the large-current connector 27 has fitted to the steering wheel side, the rotative housing 5 can rotate together with the steering wheel.

The terminals 25*a* and 25*b* for carrying small currents are connected to a small-current connector 13 on the steering wheel side. The small-current connector 13 is coupled to a small-current connector on the power supply side, and the large-current connector 15 is coupled to a large-current connector on the power supply side.

With this condition, operating the steering wheel causes the rotative housing 5, rotative holder 77, and attachment 21 to rotate together with the steering wheel. This rotation also causes the rotating-end terminals 109*a* and 109*b* on the inner ends of the flat cables 103*a* and 103*b* to move together pivotally with the rotative holder 77. This pivotal movement causes the mid folding portions 113*a* and 113*b* of the flat cables 103*a* and 103*b* to move, so that the floating spacers 83*a* and 83*b* pivotally rotate together with the mid folding portions 113*a* and 113*b* relative to the stationary housing 3.

Therefore, electric power can be supplied to the steering wheel side by means of the set 101 of flat cables, allowing energizing the air bag apparatus or the alarm provided to the steering wheel, the shift-down switch and shift-up switch of the automatic transmission, the ASCD (auto speed control device) switch, and the audio switch, independently of the operation of the steering wheel. At the same time as the floating pivotal movement of the floating spacers 83*a* and 83*b*, the floating contacts 87*a* and 87*b* also perform floating pivotal movement. Because the stationary contacts 57*a* and 57*b* and the movable contacts 71*a* and 71*b* have an annular shape that runs along the locus of pivotal movement of the floating spacers 83*a* and 83*b*, the resilient force of the flat spring 93 causes the contacts 89*a* and 89*b* of the floating contact 87*a* to be in contact with the stationary contact 57*a* and movable contact 71*a* at all times. Likewise, the resilient force of the flat spring 95 causes the contacts 91*a* and 91*b* of the floating contact 87*b* to be in contact with the stationary contact 57*b* and movable contact 71*b* at all times.

Therefore, electric power can be supplied from the power supply side to the steering wheel side independently of the operation of the steering wheel, the electric power being supplied from the large-current connector 15 to the large-current connector 27 through the stationary contacts 57*a* and 57*b*, floating contacts 87*a* and 87*b*, and movable contacts 71*a* and 71*b*. In this manner, a large current can be supplied to, for example, the handle heater independently of the operation of the steering wheel. Therefore, this structure prevents large current from flowing through the set 101 of flat cable, thereby protecting the flat cable.

Because the floating contacts 87*a* and 87*b* are provided on the floating spacers 83*a* and 83*b*, space can be utilized efficiently to form a slip ring mechanism having the stationary contacts 57*a* and 57*b*, movable contacts 71*a* and 71*b*, and floating contacts 87*a* and 87*b* without making the overall size of the rotary connector larger. In addition, the slip ring mechanism that includes the stationary contacts 57*a* and 57*b*, movable contacts 71*a* and 71*b*, and floating contacts 87*a* and 87*b* can be accommodated in a closed space defined between the stationary housing 3 and the rotative housing 5. Thus, this structure prevents leakage of sounds created by sliding motion between the stationary contacts 57*a* and 57*b*, movable contacts 71*a* and 71*b*, and floating contacts 87*a* and 87*b*, thereby reducing abnormal sounds greatly.

In addition, the structure ensures that the contact receiving recesses 97*a* and 97*b* receive the floating contacts 87*a* and 87*b*, and the two opposed ends of the floating contacts 87*a* and 87*b* resiliently contact the stationary contacts 57*a* and 57*b* and movable contacts 71*a* and 71*b*, respectively. Thus, electric power can be reliably supplied to the electrical apparatuses on the steering wheel side.

The structure ensures that the spring force of the flat spring 93 causes the contacts 89*a* and 89*b* of the floating contact 87*a* to resiliently contact the stationary contacts 57*a* and movable contact 71*a*, and the contacts 89*a* and 89*b* can be electrically continuous through the flat spring 93. The structure also ensures that the spring force of the flat spring 95 causes the contacts 91*a* and 91*b* of the floating contacts 87*b* to resiliently contact the stationary contacts 57*b* and movable contact 71*b*, and the contacts 91*a* and 91*b* can be electrically continuous through the flat spring 95. Thus, without increasing the size of the rotary connector, electric power can be supplied from the power supply side to the electrical apparatuses on the steering wheel side through the stationary contacts 57*a* and 57*b*, floating contacts 87*a* and 87*b*, and movable contacts 71*a* and 71*b*, independently of the operation of the steering wheel.

In the aforementioned embodiment, the flat springs 93 and 95 cause the contacts 89*a*, 89*b*, 91*a*, and 91*b* to resiliently contact the floating contacts 87*a* and 87*b* to the stationary contacts 57*a* and 57*b* and the movable contacts 71*a* and 71*b*, respectively. Alternatively, the construction shown in FIG. 5 may be possible.

Figure 5:
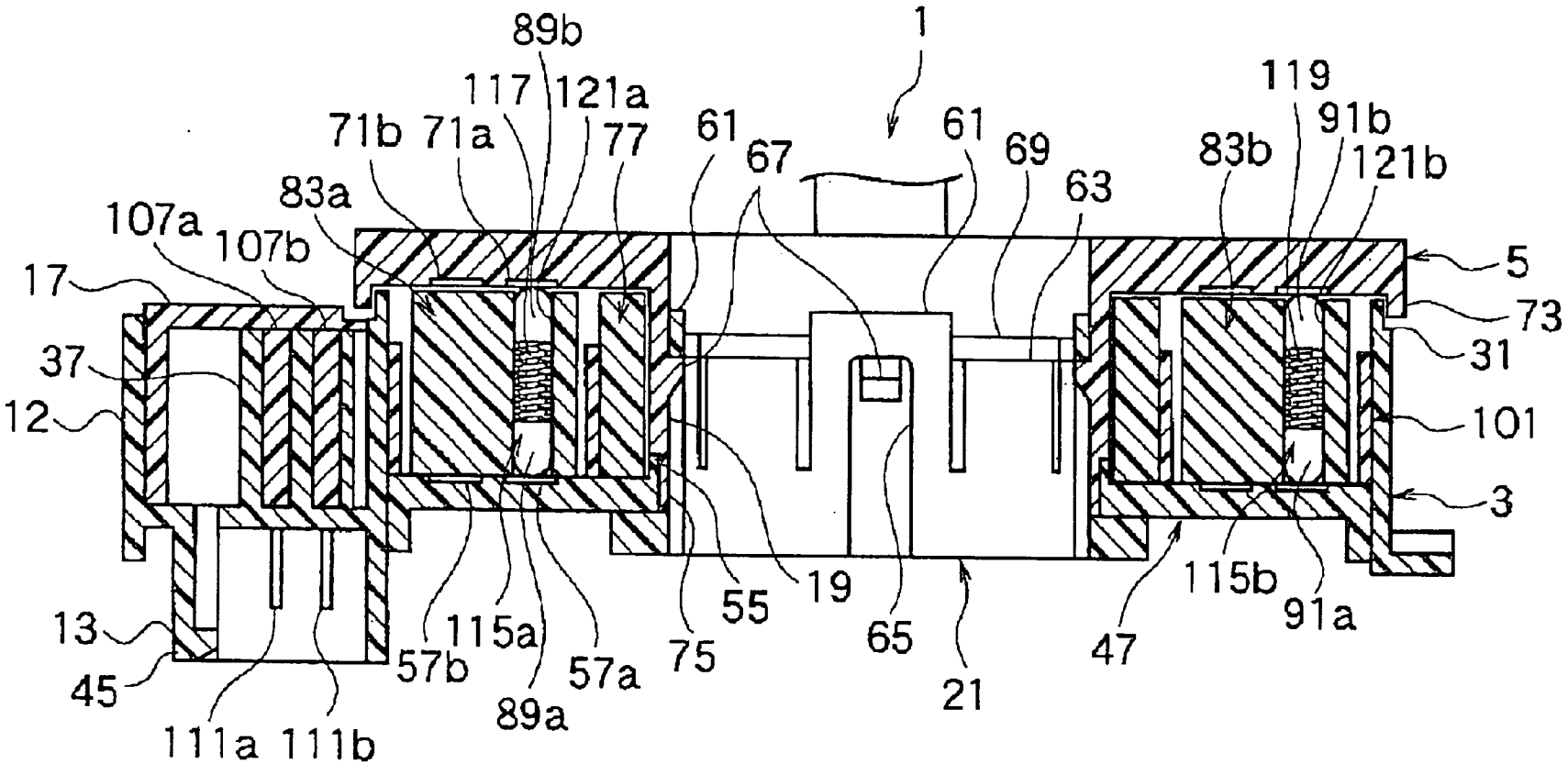
FIG. 5 is a cross-sectional view of a second embodiment taken along the same line of FIG. 4.

FIG. 5 is a cross-sectional view corresponding to FIG. 4. According to the construction in FIG. 5, the floating contacts 115*a* and 115*b* employ the electrically conductive coil springs 117 and 119 in place of the flat springs 93 and 95 for the floating contacts 87*a* and 87*b*, respectively.

Contact receiving recesses 121*a* and 121*b* that receive the floating contacts 115*a* and 115*b* are in the form of a through-hole. The coil spring 117 may be in one piece with the contacts 89*a* and 89*b* or assembled between the contacts 89*a* and 89*b*. The coil spring 119 and the contacts 91*a* and 91*b* may be formed in a manner similar to the coil spring 117. The other configuration of the rotary connector 1 shown in FIG. 5 is the same as the aforementioned embodiment shown in FIGS. 1 to 4.

Thus, in the embodiment in FIG. 5, the repulsive force of the coil spring 117 for the floating contact 115*a* causes the contacts 89*a* and 89*b* to resiliently contact the stationary contact 57*a* and movable contact 71*a*. With the floating contact 115*b*, the repulsive force of the coil spring 119 causes the contacts 91*a* and 91*b* to resiliently contact the stationary contact 57*b* and movable contact 71*b*, while also making electrical continuity between the contacts 89*a* and 89*b* by means of the coil spring 117, and between the contacts 91*a* and 91*b* by means of the coil spring 119.

Thus, the present embodiment also provides much the same advantages as the previously mentioned embodiment. In the present embodiment, the contact receiving recesses 121*a* and 121*b* may be in the shape of a through-hole, which will facilitate manufacture of the floating spacers 83*a* and 83*b*. Because the floating contacts 115*a* and 115*b* do not have a particular orientation, the floating contacts 115*a* and 115*b* may be assembled into the contact receiving recesses 121*a* and 121*b* without difficulty.

The rotary connector 1 may be in the form in which the aforementioned rotative member and the stationary member are interchanged. In other words, the stationary housing 3 may be mounted under the steering wheel so that the housing 3 actually functions as a rotary member, and the rotative housing 5 may be fixed to the base of the combination switch so that the housing 5 actually functions as a stationary member. This interchanged structure also allows electrical connection between the apparatuses on the steering wheel side and the apparatuses on the vehicle body side as in the rotary connector 1.

If the slip ring device is used to supply current to a single electrical circuit, then the following configuration can be employed. That is, the floating spacers 83*a* and 83*b* may be an electrically conductive body in the shape of a doughnut. A contact in the form of a contact spring is disposed on the underside of the rotative housing 5 and slides on the upper surface of the floating spacers 83*a* and 83*b*. A contact in the form of a contact spring, which slides on the underside of the floating spacers 83*a* and 83*b*, is disposed on the upper surface of the bottom housing 47 of the stationary housing 3. These two contacts are then electrically connected through the electrically conductive floating spacers 83*a* and 83*b*. The apparatuses are grounded via the steering wheel.

Figure 10:
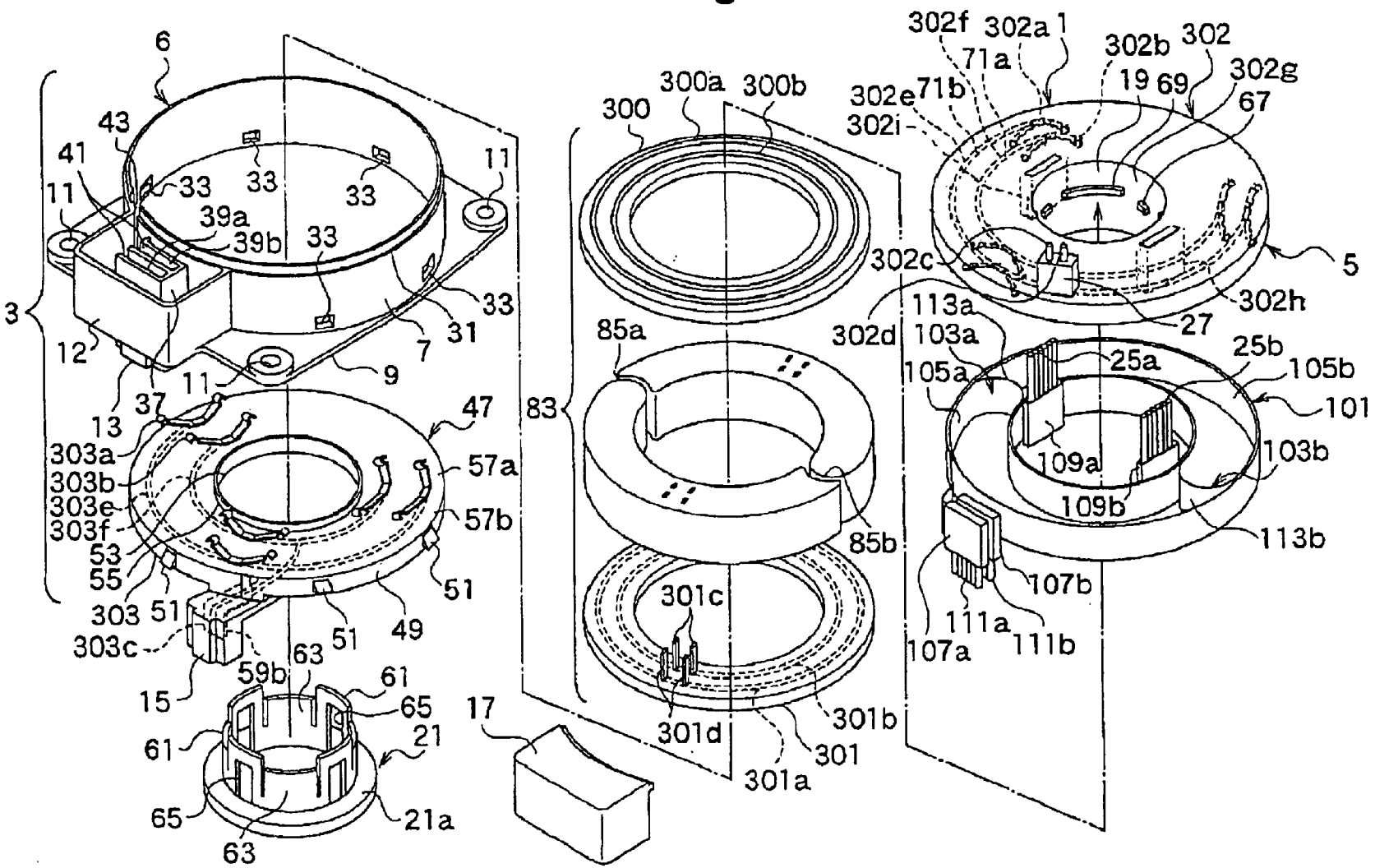
FIG. 10 is an exploded perspective view of a rotary connector according to a fourth embodiment.

The rotary connector 1 may be in the form of a slip ring device having the following configuration. The floating spacers 83*a* and 83*b* are arranged to form the shape of a doughnut as shown in FIG. 10. An annular-shaped insulating plate 300 is placed on the floating spacers 83*a* and 83*b* to cover the gaps 85*a* and 85*b*, and another annular insulating plate 301 is placed under the floating spacers 83*a* and 83*b* to cover the gaps 85*a* and 85*b*. Annular floating contacts 300*a* and 300*b* are provided on the upper insulating plate 300, and floating contacts 301*a* and 301*b* are disposed on the underside of a lower insulating plate 301. Movable contacts 302*a* and 302*b* are disposed on the underside of a rotative housing 302 to contact the floating contacts 300*a* and 300*b*. Stationary contacts 303*a* and 303*b* are disposed on the upper surface of a bottom housing 303 of the stationary housing 3 to contact the floating contacts 301*a* and 301*b*.

The outer floating contact 300*a* formed on the upper insulating plate 300 and the outer floating contact 301*a* formed on the underside of the lower insulating plate 301 are electrically connected through the terminals 301*d* that extend through the floating spacers 83*a* and 83*b*. Likewise, the inner floating contact 300*b* formed on the upper insulating plate 300 and the inner floating contact 301*b* formed on the underside of the lower insulating plate 301 are electrically connected through the terminals 301*c* that extend through the floating spacers 83*a* and 83*b*.

The movable contacts 302*a* and 302*b* are resilient contacts, for example, in the form of a plurality of flat springs and are disposed in a circumferential direction at equal intervals on a rotative housing 302. The movable contacts 302*a* and 302*b* provided on the rotative housing 302 resiliently urge the surface of the upper insulating plate 300 so that an even urging force prevents the rotative housing 302 from tilting. The plurality of outer movable contacts 302*a* arranged on the rotative housing 302 are on the same circle and are electrically continuous through a terminal 302*e*, which in turn is electrically continuous to a terminal 302*c*. A plurality of inner movable contacts 302*b* arranged on the rotative housing 302 are on the same circle and are electrically continuous through a terminal 302*f*, which in turn is continuous to the terminal 302*d*.

The rotative housing 302 has couplers 302*h* and 302*i* formed on locations closer to the center of the rotative housing 302 than a terminal 302*f*. The couplers 302*h* and 302*i* receive terminals 109*a* and 109*b* of the set 101 of flat cables. The couplers 302*h* and 302*i* are formed adjacent to the shaft sleeve 302*g* or continuous to the shaft sleeve 302*g*.

The stationary contacts 303*a* and 303*b* are resilient contacts in the form of a plurality of flat springs and are arranged at equal intervals on a stationary housing 303 in a circumferential direction. The stationary contacts 303*a* and 303*b* provided on the stationary housing 303 resiliently urge the surface of the lower insulating plate 301 so that an even urging force prevents the stationary housing 303 from tilting. The plurality of outer stationary contacts 303*a* arranged on the stationary housing 303 are on the same circle and are electrically continuous through the terminal 303*e*, which in turn is electrically continuous to the terminal 303*c*.

The plurality of inner stationary contacts 303*b* arranged on the stationary housing 303 are on the same circle and are electrically continuous through a terminal 303*f*, which in turn is electrically continuous to a terminal 303*d*.

Figure 6:
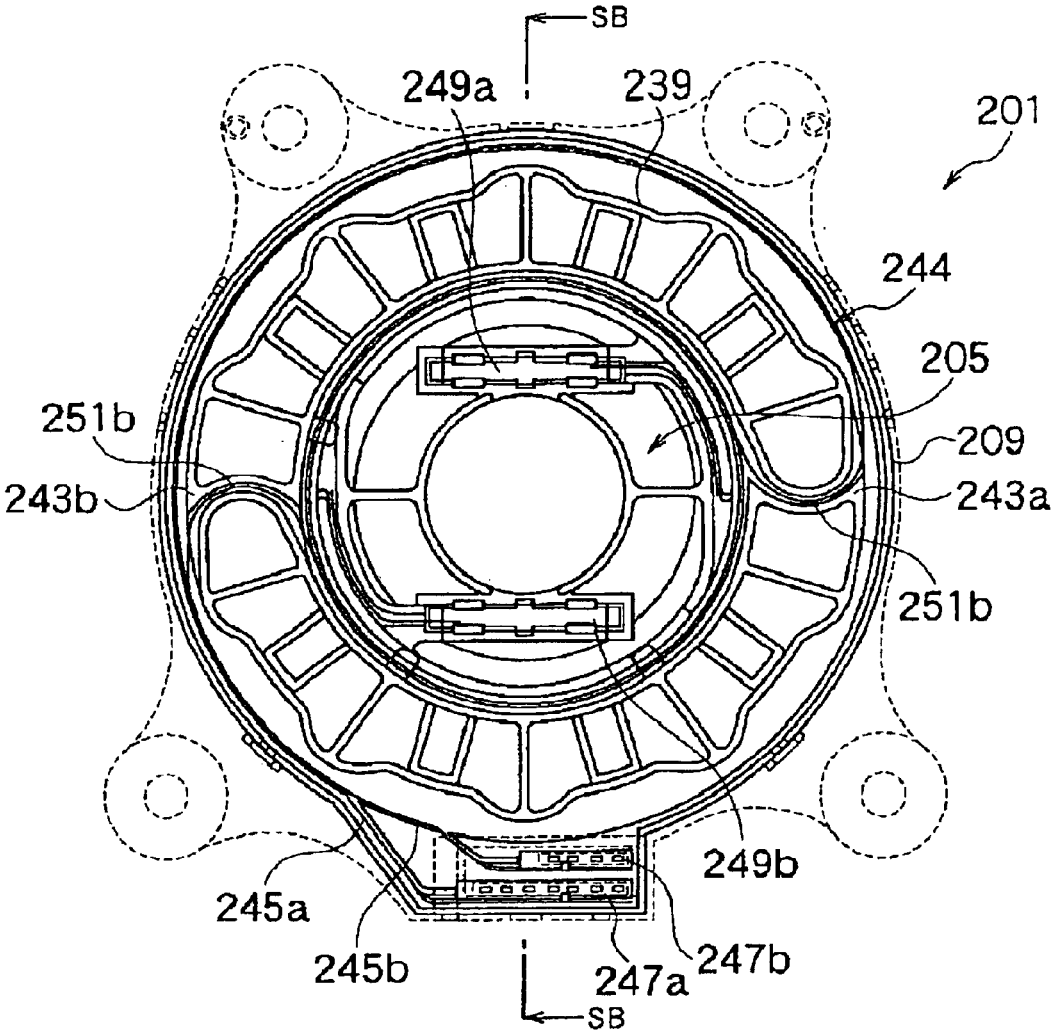
FIG. 6 is a top view of the interior of a rotary connector according to a third embodiment.
Figure 7:
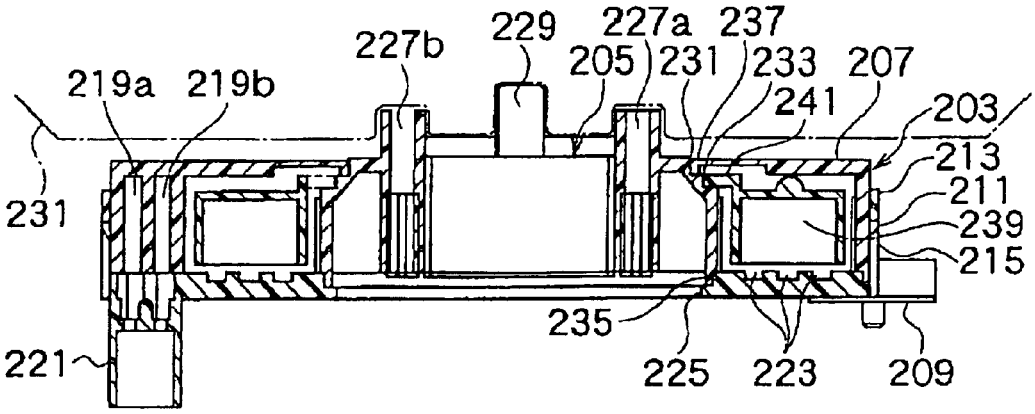
FIG. 7 is a cross-sectional view of the third embodiment taken along line SB—SB of FIG. 6.
Figure 8:
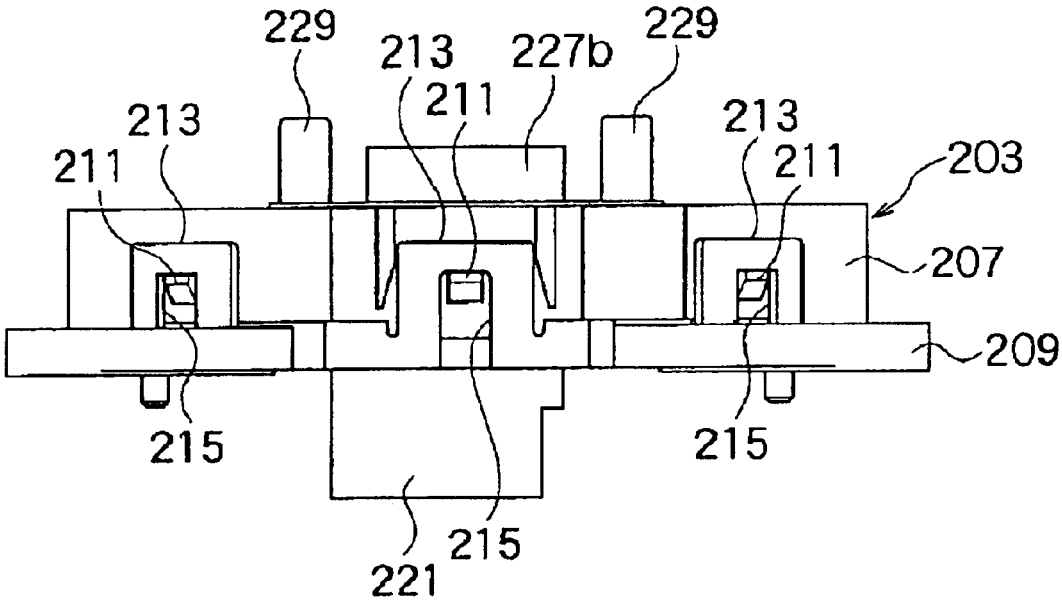
FIG. 8 is a side view of a rotary connector according to the third embodiment.
Figure 9:
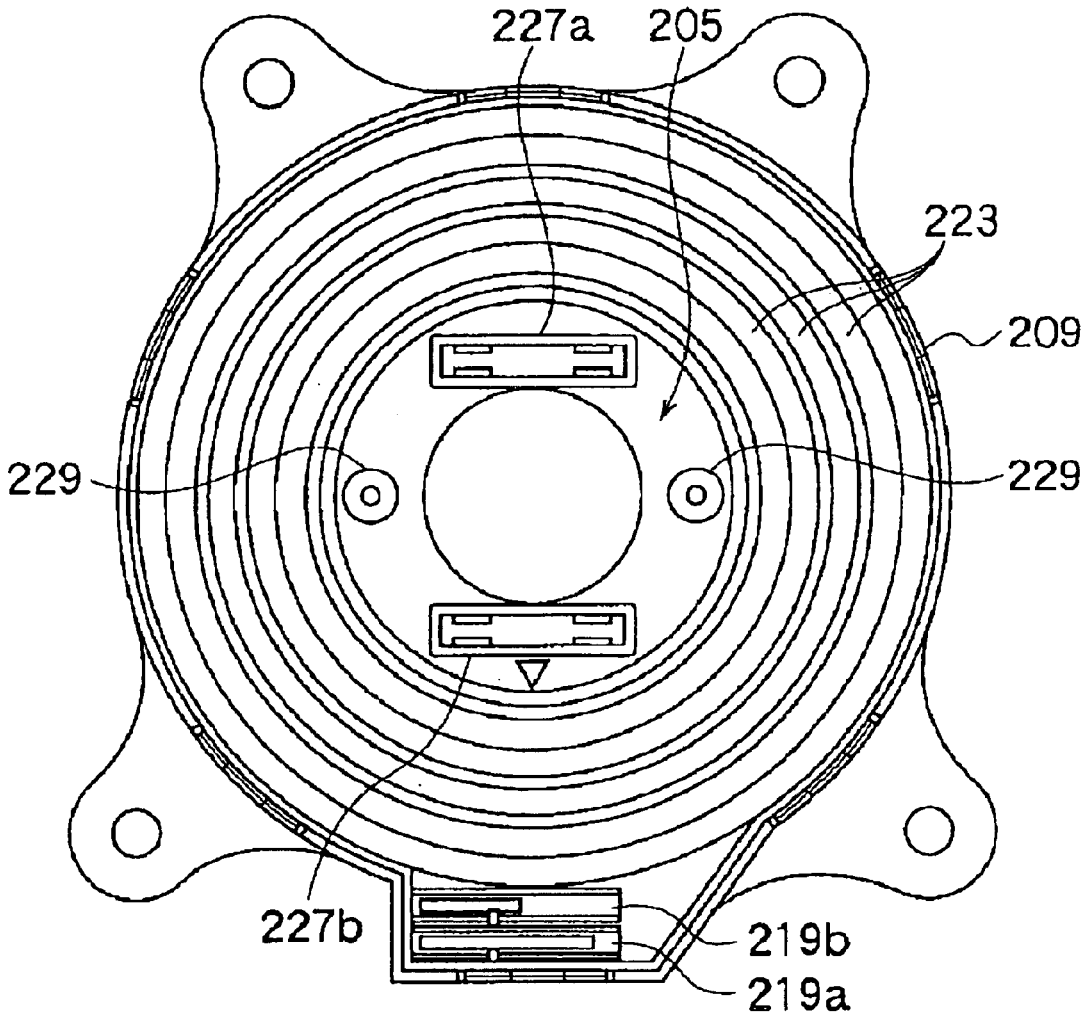
FIG. 9 is a top view illustrating grooves formed in a bottom housing according to the third embodiment.

FIGS. 6 to 9 illustrate a rotary connector 201 according to another embodiment of the present invention. FIG. 6 is a top view illustrating the interior of the rotary connector 201. FIG. 7 is a cross-sectional view taken along line SB—SB of FIG. 6. FIG. 8 is a side view of the rotary connector 201, and FIG. 9 is a top view of a bottom housing of the rotary connector 201.

As shown in FIGS. 6 to 9, the rotary connector 201 has much the same configuration as the first embodiment described above. In other words, the rotary connector 201 has a rotor 205 rotatably supported on a stationary housing 203.

The stationary housing 203 includes an upper housing 207 and a bottom housing 209. The upper housing 207 has a plurality of engagement lugs 211 arranged in a circumferential direction, and the bottom housing 209 has a plurality of resilient tongues 213 corresponding to the engagement lugs 211. The resilient tongues 213 have engagement windows 215 formed therein that are engaged with the engagement lugs 211. When the engagement lugs 211 engage the engagement windows 215 formed in the resilient tongues 213, the housing 207 is coupled to the bottom housing 209.

The upper housing 207 and bottom housing 209 have terminal-accommodating recesses 219*a* and 219*b*, respectively, on their side walls. The bottom housing 209 has a small-current connector 221 located under the terminal-accommodating recesses 219*a* and 219*b*.

Grooves 223 are formed in an inner bottom surface of the bottom housing 209 by removing off excess material. The grooves 223 include three concentric annular grooves with the rotor 205 at their center. The grooves 223 are intended to store abrasion particles produced within the stationary housing 203 and foreign materials entered from outside. The grooves 223 can be any shape and any number, provided that they serve to perform their intended function. A bearing portion 225 is formed in an inner circumferential surface of the bottom housing 209.

The rotor 205 has connectors 227*a* and 227*b*. The rotor 205 also has an engagement pin 229 on its upper surface. The connectors 227*a* and 227*b* fit to their mating connectors provided on the underside of a steering wheel 231, thereby being connected to electrical apparatuses on the steering wheel 231. Just as in the previously described embodiments, the electrical apparatuses include, for example, an air bag apparatus or an alarm provided to the steering wheel, a shift-down switch and a shift-up switch for an automatic transmission, an ASCD (auto speed control device) switch, and an audio switch. The engagement pin 229 is of the construction in which the engagement pin 229 engages recesses formed in the steering wheel 231, and the rotor 205 rotates together with the steering wheel 231.

The rotor 205 has an upper stepped portion 231 and a lower stepped portion 233 that are formed in an upper outer circumferential surface of the rotor 205, and a stepped portion 235 that is formed in a lower outer circumferential surface of the rotor 205. The upper stepped portion 231 engages an inner circumferential edge 237 of the upper housing 207, while the stepped portion 235 of the rotor 205 engages the bearing portion 225 of the bottom housing 209. Thus, the structure is such that the rotor 205 is rotatably supported on the stationary housing 203.

The space defined by the stationary housing 203 and the rotor 205 accommodates a floating spacer 239. A plurality of engagement straps 241, disposed in a circumferential direction on an upper inner circumferential surface of the floating spacer 239, are engaged with the lower stepped portion 233, so that the floating spacer 239 has space on its upper and lower sides and left and right sides in the stationary housing 203. The floating spacer 239 has a pair of gaps 243*a* and 243*b*.

Just as in the previously described embodiment, a set 244 of flat cables is wound around the inner and outer circumferential surfaces of the floating spacer 239. In other words, the set 244 of flat cables includes a first flat cable 245*a* and a second flat cable 245*b*. The first flat cable 245*a* and second flat cable 245*b* have at their one ends fixed-end terminals 247*a* and 247*b*, respectively, and at their other ends rotating-end terminals 249*a* and 249*b*, respectively.

The first flat cable 245*a* makes about ¾ of one complete run starting from the fixed-end terminal 247*a* and continuing to a mid folding portion 251*a* of the first cable 245*a* which passes through a gap 243*a* in the floating spacer 239. The first flat cable 245*a* then folds back to make about one complete run along the inner circumferential surface of the floating spacer 239 to reach the rotating-end terminal 249*a*.

The second flat cable 245*b* starts from the fixed-end terminal 247*b* and continues to a mid folding portion 251*b*. The mid folding portion 251*b* of the second cable 245*b* passes through a gap 243*b* in the floating spacer 239. The second flat cable 245*b* then folds back to make about one complete run along the inner circumferential surface of the floating spacer 239 to reach the rotating-end terminal 249*b*.

The fixed-end terminals 247*a* and 247*b* are accommodated in terminal-accommodating recesses 219*a* and 219*b*, respectively. The terminal elements of the terminals 247*a* and 247*b* are exposed in the small-current connector 221. The rotating-end terminals 249*a* and 249*b* are held by the connectors 227*a* and 227*b* on the rotating ends, respectively.

Thus, with the example shown in FIGS. 6 to 9, electric power can be supplied to the steering wheel 231 side from the power supply side through the set 244 of flat cables without being interfered by the operation of the steering wheel.

There is a possibility that due to a closed space defined by the stationary housing 203 and rotor 205, abrasion particles produced by friction at various parts and foreign materials entered during the assembly process may enter the space between the bearing portion 225 and the stepped portion 235 to create abnormal sounds or require a larger driving torque.

There is another possibility that abrasion particles and foreign materials may be deposited on the set 244 of flat cables, so that abnormal sounds may be produced or increase the required driving toque due to the friction between the flat cables 245*a* and 245*b* and between the flat cables and the floating spacer 239.

There is still another possibility that abrasion particles and foreign materials enter the gaps 243*a* and 243*b* of the floating spacer 239 to increase the friction between the first and second flat cables 245*a* and 245*b* leading to breaking of the first and second flat cables 245*a* and 245*b*.

Thus, in this example, the grooves 223 of the bottom housing 209 store abrasion particles produced in the rotary connector and foreign materials entered from outside. As a result, the chances of the abrasion particles and foreign materials entering the bearing portion 225 and stepped portion 235 are minimized, and the particles and foreign materials are prevented from being deposited to the set 244 of flat cables and from entering the gaps 243*a* and 243*b* of the floating spacer 239.

Thus, abnormal sounds and an increase in driving torque can be minimized, preventing the set 244 of flat cables from breaking. Further, the grooves 223 reduce an area through which the flat cables 245*a* and 245*b* contact the surface of the bottom housing 209 at the folding portion 251*a*, thereby reducing the sliding sounds created between the surface and the flat cables 245*a* and 245*b*.

Providing the grooves 223 of the aforementioned construction on the bottom housing 47 of the rotary connector 1 of the first embodiment described above offers the same advantages as in the presently described embodiment. Because the bottom housing 47 has the stationary contacts 57*a* and 57*b*, the grooves 223 can be formed between the stationary contacts 57*a* and 57*b*, on the inner side of the stationary contact 57*a*, and on the outer side of the stationary contact 57*b*.

The present embodiment can be modified while still offering the same advantages as the previously described embodiment. That is, a flange is provided on the rotor 205 to extend above the floating spacer 239. The flange has an annular movable contact. An annular stationary contact is provided between the grooves 223 in the bottom housing 209. The floating spacer 239 supports floating contacts thereon just as in the previously described embodiment. Thus, the modification of the present embodiment can still offer the same advantages as the previously described embodiment. In this case, the grooves 223 may be omitted.

The structure of the present invention has been described above. The main features and advantages of the invention will now be summarized.

As described above, the rotary connector of the present invention has a stationary member supported on the body of an automobile, and a rotative member that can rotate together with a steering wheel. Operating the steering wheel causes the rotative member to rotate together with the steering wheel. Then, a cable end portion, electrically connected to electrical apparatuses on the steering wheel side, moves while rotating together with the rotative member. The flat cable has a mid folding portion that passes through a gap in a floating spacer so that the flat cable folds back and is wound around an outer circumferential surface and an inner circumferential surface of the floating spacer, the flat cable lying between the stationary member and the rotative member.

Therefore, through the pivotal floating movement of the floating spacer that follows the rotation of the rotative member, an amount of slack in the flat cable allows the cable end portion, electrically connected to electrical apparatuses on the steering wheel side, to smoothly rotate together with the rotative member, the cable end portion rotating relative to another cable end portion that is supported on the stationary member and connected to the power supply.

Thus, electric power can be supplied to small-current electrical apparatuses such as an air bag and an alarm mounted on the steering wheel, a shift-down switch and a shift-up switch of an automatic transmission, an ASCD (automatic speed control device) switch, and an audio switch through the flat cables from the power supply side independently of the operation of the steering wheel.

Moreover, the floating contact provided on the floating spacer is in contact with the stationary contact on the stationary member and the movable contact on the rotative member, so that when the floating spacer performs pivotal floating movement, the floating contact can be in contact with the stationary contact and movable contact at all times. Thus, the floating contact, stationary contact, and movable contact form a slip ring mechanism, increasing the number of electrical paths so that more electrical apparatuses can be mounted on the steering wheel.

If the slip ring mechanism is designed to be capable of carrying a larger current than the flat cable, such a large current can be supplied independently of the operation of the steering wheel through the stationary contact, floating contact, and movable contact from the power supply to electrical apparatuses such as a handle heater, which usually consumes a larger current exceeding the current capacity of the flat cables on the steering wheel side. This structure does not require a large current to flow through the flat cables, thereby protecting the flat cables.

Because the floating contact is provided to the floating spacer, space can be efficiently utilized so that the overall apparatus need not be larger, and therefore, the slip ring mechanism having the stationary contact, movable contact, and floating contact can be accommodated in the housing of the rotary connector that accommodates a flat cable.

This structure prevents dust and particles from entering the rotary connector from outside and being deposited on the contacts to cause poor contact, and minimizes leakage of sliding sounds of the movable contact to the outside of the rotary connector.

According to another aspect of the present invention, the floating contact provided to the floating spacer resiliently contacts the annular stationary contact on the stationary member and the annular movable contact on the rotative member. When the floating spacer performs pivotal floating movement, the floating contact resiliently contacts the annular stationary contact and movable contact at all times.

Thus, because the stationary contact on the stationary member and the movable contact on the rotative member are formed in an annular shape, the stationary contact and movable contact can be made thin, so that the stationary contact and movable contact can be accommodated without having to increase the gap between the stationary member and the floating spacer and the gap between the rotative member and the floating spacer. Thus, the overall thickness of the rotary connector will not increase.

The floating spacer accommodates the floating contact that is in resilient contact with the stationary contact and movable contact and occupies space in a direction of thickness of the rotary connector. Thus, a slip ring mechanism that includes the stationary contact, movable contact, and floating contact can be formed by efficiently utilizing space without making the overall size of the rotary connector larger.

The slip ring mechanism, which includes the stationary contact, movable contact, and floating contact, can be provided in a space defined by the stationary member and the rotative member. This structure inhibits the sliding sounds created by the stationary contact, movable contact, and floating contact from leaking to the outside of the rotary connector, substantially preventing the vehicle driver from hearing the sliding sounds.

According to another aspect of the present invention, the contact receiving recess is formed in the floating spacer, and receives the floating contact therein. The contact receiving recess allows two opposed ends of the floating contact to expose to the stationary contact and the movable contact, so that the two opposed ends resiliently contact the stationary contact and the movable contact. Thus, the space in the floating spacer is efficiently utilized so that the floating contact can be provided in the floating spacer, ensuring that the overall size of the rotary connector is not made larger.

Because the contact receiving recess receives the floating contact reliably, the opposed ends of the floating contact can be in reliable resilient contact with the stationary contact and movable contact, thereby ensuring that electric power is supplied to the electrical apparatuses on the steering wheel side.

According to another aspect of the present invention, the urging force of the spring between the two opposed ends ensures that the contacts at the two opposed ends are in resilient contact with the stationary contact and movable contact. Moreover, the contacts at the two opposed ends can be made electrically continuous by using an electrically conductive spring.

While preventing the overall size of the rotary connector from becoming large, electric power can be supplied from the power supply side to the electrical apparatuses on the steering wheel side through the stationary contact, floating contact, and movable contact independently of the operation of the steering wheel. The contact receiving recess can be in the shape of a through-hole, so that the floating spacer can be manufactured easily. The floating contact is not polarized and has no special orientation, so that the floating contact can be assembled readily.

While the invention has been specifically described in connection with specific embodiments thereof, it is to be understood that this is by way of illustration and not of limitation, and the scope of the appended claims should be construed as broadly as the prior art will permit.

What is claimed is:

1. A rotary connector comprising:

a stationary member supported on a body side of an automobile;

a rotative member rotatably supported on the stationary member, the rotative member being rotatable together with a steering wheel;

a floating spacer disposed between the stationary member and the rotative member, said floating spacer having a gap that extends in a radial direction of the floating spacer so that an inner space of the floating spacer communicates with an outer space of the floating spacer through the gap, said floating spacer being pivotal when the rotative member rotates; and a flat cable having one end supported on the stationary member and connected to a power supply side and another end supported on the rotative member and connected to an electrical apparatus on the steering wheel side, and a mid folding portion that passes through the gap in a floating spacer to fold back so that the flat cable is wound around an outer surface and an inner surface of the floating spacer, the flat cable lying between the stationary member and the rotative member;

wherein the rotary connector has a slip ring mechanism, the slip ring mechanism comprising:

a stationary contact provided on the stationary member, the stationary contact being connected to the power supply and opposing the floating spacer so that the stationary contact extends along a pivotal path of the floating spacer;

a movable contact provided on the rotative member, said movable contact being connected to an electrical apparatus on the steering wheel side and opposing the floating spacer so that said movable contact extends along a pivotal path of the floating spacer; and a floating contact provided to the floating spacer, said floating contact being electrically connected to the stationary contact and said movable contact.

2. The rotary connector according to claim 1, wherein:

said stationary contact is annular;

said movable contact is annular; and said floating contact is in resilient contact with the stationary contact and the movable contact.

3. The rotary connector according to claim 2, further comprising:

a contact-receiving recess formed in the floating spacer;

said floating contact being received in the contact-receiving recess; and said contact-receiving recess allowing two opposed ends of said floating contact to expose to the stationary contact and said movable contact, respectively.

4. The rotary connector according to claim 3, wherein said floating contact has contacts on its opposed two ends thereof and an electrically conductive spring that makes the contacts on the opposed two ends electrically continuous with each other and makes said floating contact in resilient contact with said stationary contact and said movable contact.

5. The rotary connector according to claim 1, further comprising:

a contact-receiving recess formed in the floating spacer;

said floating contact being received in the contact-receiving recess; and said contact-receiving recess allowing two opposed ends of said floating contact to expose to the stationary contact and said movable contact, respectively.

6. The rotary connector according to claim 5, wherein said floating contact has contacts on its opposed two ends thereof and an electrically conductive spring that makes the contacts on the opposed two ends electrically continuous with each other and makes said floating contact in resilient contact with said stationary contact and said movable contact.

7. A rotary connector comprising:

a stationary member;

a rotative member rotatably supported on the stationary member;

a flat cable having a first end supported on the stationary member and connected to a power supply side and a second end supported on the rotative member and connected to an electrical apparatus, and a slip ring mechanism comprising an annular stationary contact provided on the stationary member, an annular movable contact provided on the rotative member, and a floating contact in resilient contact with said stationary contact and said movable contact, and further comprising:

a floating spacer disposed between the stationary member and the rotative member, said floating spacer having a gap that extends in a radial direction of the floating spacer so that an inner space of the floating spacer communicates with an outer space of the floating spacer through the gap, said floating spacer being pivotal when the rotative member rotates; and said flat cable having a mid folding portion that passes through the gap in the floating spacer to fold back so that the flat cable is wound around an outer surface and an inner surface of the floating spacer.

8. The rotary connector according to claim 7, wherein said movable contact opposes the floating spacer so that said movable contact extends along a pivotal path of the floating spacer.

9. The rotary connector according to claim 7, wherein a contact-receiving recess is formed in the floating spacer, said floating contact is received in the contact-receiving recess, and said contact-receiving recess allows two opposed ends of said floating contact to be exposed to the stationary contact and the movable contact, respectively.

10. The rotary connector according to claim 7, wherein said floating contact has contacts on its opposed two ends thereof and an electrically conductive spring that makes the contacts on the opposed two ends electrically continuous with each other and makes said floating contact in resilient contact with said stationary contact and said movable contact.

* * * * *